US010681968B2

(12) United States Patent
Marsh

(10) Patent No.: US 10,681,968 B2
(45) Date of Patent: Jun. 16, 2020

(54) WADING STICK WITH EXPANDING SUPPORT

(71) Applicant: Robert E Marsh, Kansas City, MO (US)

(72) Inventor: Robert E Marsh, Kansas City, MO (US)

( * ) Notice: Subject to any disclaimer, the term of this patent is extended or adjusted under 35 U.S.C. 154(b) by 0 days.

(21) Appl. No.: 16/108,351

(22) Filed: Aug. 22, 2018

(65) Prior Publication Data

US 2019/0059533 A1 Feb. 28, 2019

Related U.S. Application Data

(60) Provisional application No. 62/550,369, filed on Aug. 25, 2017.

(51) Int. Cl.
*A45B 9/04* (2006.01)
*A45B 7/00* (2006.01)
*A63C 11/24* (2006.01)

(52) U.S. Cl.
CPC ..... *A45B 9/04* (2013.01); *A45B 7/00* (2013.01); *A63C 11/24* (2013.01); *A45B 2200/05* (2013.01)

(58) Field of Classification Search
CPC ..... A45B 9/04; A45B 2009/002; A45B 7/00; A61H 3/0288; A61H 3/0277; A61H 2201/0165; A63C 11/22; A63C 5/061; A63C 2203/20
USPC .... 135/65–66, 77, 82, 84, 86; 280/819, 823, 280/825
See application file for complete search history.

(56) References Cited

U.S. PATENT DOCUMENTS 2,123,437 A * 7/1938 Ring ..... A63C 11/222 280/824
3,645,553 A * 2/1972 Hinterholzer ..... A63C 11/24 280/824
3,858,900 A * 1/1975 Quinn ..... A63C 11/24 280/824
4,014,559 A * 3/1977 Funke ..... A45F 3/04 280/824
5,301,704 A * 4/1994 Brown ..... A45B 9/04 135/78
5,392,801 A * 2/1995 Hannoosh ..... A45B 3/00 135/65
D359,162 S * 6/1995 Knight ..... D3/17
5,593,334 A * 1/1997 Thayer ..... B63B 35/83 441/76
5,727,584 A * 3/1998 Stanec ..... A45B 9/04 135/65
5,941,435 A * 8/1999 Munro, III ..... A45F 5/14 224/222
6,015,165 A * 1/2000 Artemis ..... A63C 11/24 135/84
6,131,593 A * 10/2000 Greene ..... A45B 9/04 135/77

(Continued)

FOREIGN PATENT DOCUMENTS

JP 2008272421 A * 11/2008 ..... A45B 9/04

*Primary Examiner* — Winnie Yip

(57) ABSTRACT

A wading stick is provided with an expanding elastomer support that prevents the stick from sinking into mud or other soft surfaces. The distal end of the support expands away from the stick when it contacts the soft surface. The support circumference increases in response to contact with soft surface and the increased circumference prevents the stick and support from sinking.

8 Claims, 3 Drawing Sheets

(56) References Cited

U.S. PATENT DOCUMENTS

| | | | | |
|---|---|---|---|---|
| 6,138,699 | A * | 10/2000 | Su | A45B 9/04 135/68 |
| 6,203,064 | B1 * | 3/2001 | Zaltron | A63C 11/24 280/824 |
| 6,527,001 | B1 * | 3/2003 | Saldan | A45B 9/04 135/65 |
| 7,172,219 | B2 * | 2/2007 | Spragg | A63C 11/221 280/814 |
| 8,317,229 | B2 * | 11/2012 | Virostek | A63C 11/24 280/819 |
| 9,226,556 | B1 * | 1/2016 | Chien | A61H 3/0288 |
| 9,914,849 | B2 * | 3/2018 | Bleecher | E03C 1/308 |
| 2010/0313925 | A1 * | 12/2010 | Jiang | A45B 9/04 135/82 |
| 2013/0032185 | A1 * | 2/2013 | Sato | A45B 9/04 135/68 |
| 2014/0298579 | A1 * | 10/2014 | Nowak | E03D 9/00 4/255.11 |
| 2017/0224072 | A1 * | 8/2017 | Van Varick | A45B 9/02 |
| 2017/0239130 | A1 * | 8/2017 | Rizzo | G06F 3/015 |
| 2020/0008545 | A1 * | 1/2020 | Strum | A45B 9/02 |

* cited by examiner

WADING STICK WITH EXPANDING SUPPORT

BACKGROUND OF THE INVENTION

Walking or wading in deep mud is difficult. It is helpful to have something for a person wading to push against as they walk, pulling their foot out of the mud with each step. The yanking effort often necessary to pull a foot from soft mud can be damaging to a wader's knees and hips. This invention is a wading stick to be used when wading in an area with mud. A traditional wading stick sinks in mud and is of little use. A fixed shape basket with openings—like that used on ski poles—might slightly help prevent a walking stick from sinking in the mud, but it would soon accumulate mud and become heavy, unbalanced, and impractical. The present invention addresses the long felt need for a walking stick that is useful in mud, particularly when the user is wading in water and the stability afforded by a walking stick is important.

BRIEF SUMMARY OF THE INVENTION

This invention is a wading stick with an expanding support that prevents the stick from sinking into mud or other soft surfaces. The support has a proximal end located at or near the stick and a distal end extending away from the stick and pointing in the direction of the bottom of the stick when the support is in its unexpanded configuration. The distal end of the support expands away from the stick when it contacts the mud surface such that the support circumference increases in response to contact with mud and that increased circumference prevents the stick and support from sinking too far into the mud. In a preferred embodiment the support is made of an elastomer.

DETAILED DESCRIPTION OF THE INVENTION

Figure 1:
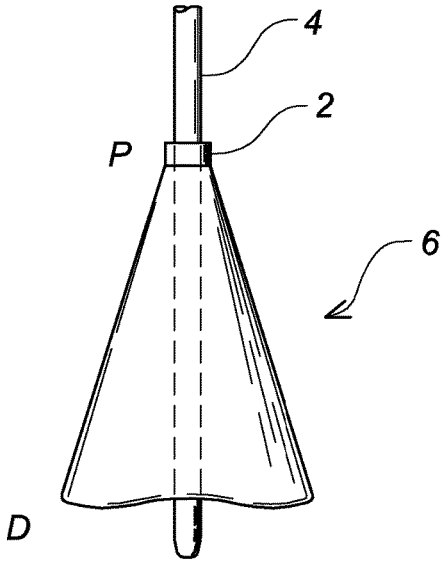
FIG. 1 is a side view of one embodiment of the invention in the closed position.

This invention provides an expanding support which is attached to or incorporated in a walking stick near the bottom of the stick. Since walking in mud is most frequently encountered when wading, this invention is called a "wading stick" but its use is not limited to wading. "Support" refers to the enlarging and contracting structure that contacts the ground or mud as downward force is applied to the wading stick. In FIG. 1 the support 6 has a proximal end (marked P in FIG. 1) located at or near the stick and a distal end (marked D in FIG. 1) extending away from the stick and pointing in the direction of the bottom of the stick when the support is in its unexpanded configuration. The distal end of the support expands away from the stick when it contacts the mud surface such that the support circumference increases and that increased circumference prevents the stick and support from sinking too far into the mud. The term "folded" refers to the support in a folded and collapsed configuration. The term "closed" refers to the unexpanded position of the support even if not folded and would be associated with the contraction of the elastomer support material to its smallest circumference. For convenience, references to a closed support should be interpreted as including a folding support unless the context clearly requires otherwise. The term "expanded" refers to the support in its unfolded, opened, or expanded configuration that presents a larger surface area in contact with the mud than that of the folded configuration. The "circumference" of the support refers to the circumference of a circle drawn around the outer perimeter of the support, whether or not that perimeter is circular. The circumference of the support at its distal end (the end away from the stick, and the "leading edge" that first contacts the mud) will be greater than or equal to the circumference at the proximal end (the end nearest the stick), with the circumference at the proximal end being slightly larger than the circumference of the stick. As the support expands, the circumference of the distal end of the support increases, ideally to at least 2 times its unexpanded circumference. The end view of the distal end of the support in its expanded position may be referred to as its footprint. "Elastomer" means a polymer, either natural or synthetic, with elastic properties.

FIG. 1 shows one embodiment of this invention with the support 6 in its closed position. As shown in FIG. 1, a support 6 attaches to a stick 4. In most cases the stick 4 has an approximately cylindrical cross section, but the shape of the stick is not critical to this invention. The support 6 may be attached to the stick 4 using a bracket 2 which attaches to both the support 6 and the stick 4 with residents, screws, or any of a variety of other fasteners well known in the art. The support 6 is installed on the stick 4 near the bottom of the stick, positioned so that the closed support extends downward in the direction of the ground. The support 6 is preferably attached so that in the closed position the support does not touch the ground. Alternatively, the support 6 may affixed to the stick 4 directly—without a separate bracket.

The support 6 is preferably constructed of an elastomer, which could include a natural polymer (like rubber) or a synthetic polymer, such as polyvinyl chloride, silicone, or many other known flexible polymer materials. Ideally, the material would have reduced mud adhesion, either by natural characteristics or treatment, as discussed in more detail below. The support 6 is expanded by upward force exerted on the distal (or leading) end of the folded support, or downward force exerted on the center top of the folded support or, in some embodiments, forces exerted on both the leading edge of the folded support and the center top of the support. In a preferred embodiment the support 6 and all associated components are integrated into one molded support unit. The elastomer construction causes the support to return to its closed position when force against its leading edge is removed (as when the stick is lifted out of the mud).

Figure 2:
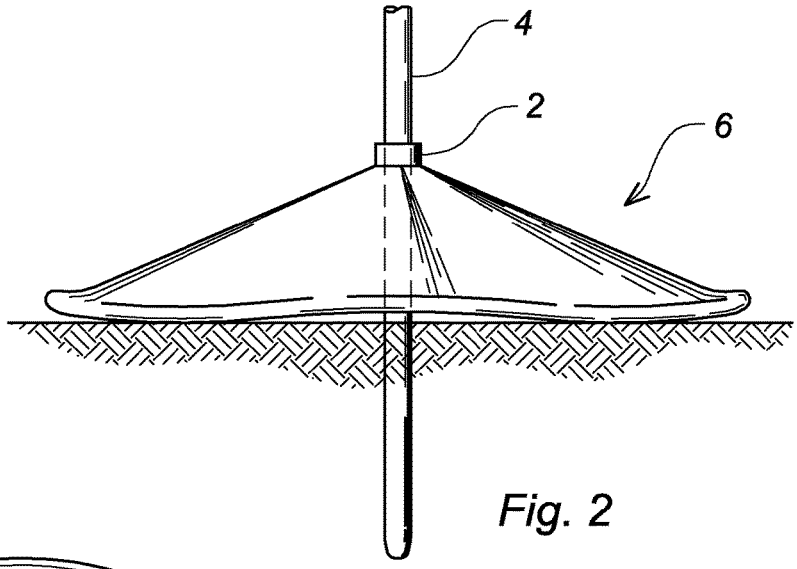
FIG. 2 is a side view of one embodiment the invention in the expanded position.

As shown in FIG. 2, when the stick is pressed in the mud and the mud contacts the leading edge of the distal end of the support 6, the pressure exerted by the wader on the stick presses the leading edge of the folded support 6 into the mud which in turn forces the support into its expanded position. In the expanded position the support presents a sufficient surface area to support a significant amount of user force (weight) applied to the stick and prevents the stick from sinking significantly further into the mud. This greater surface area is associated with a larger support "circumference" and ideally the expanded circumference is at least two times the circumference of the folded or closed support. While the term circumference is used for convenience, the actual shape of the support footprint might not be circular.

Figure 3:
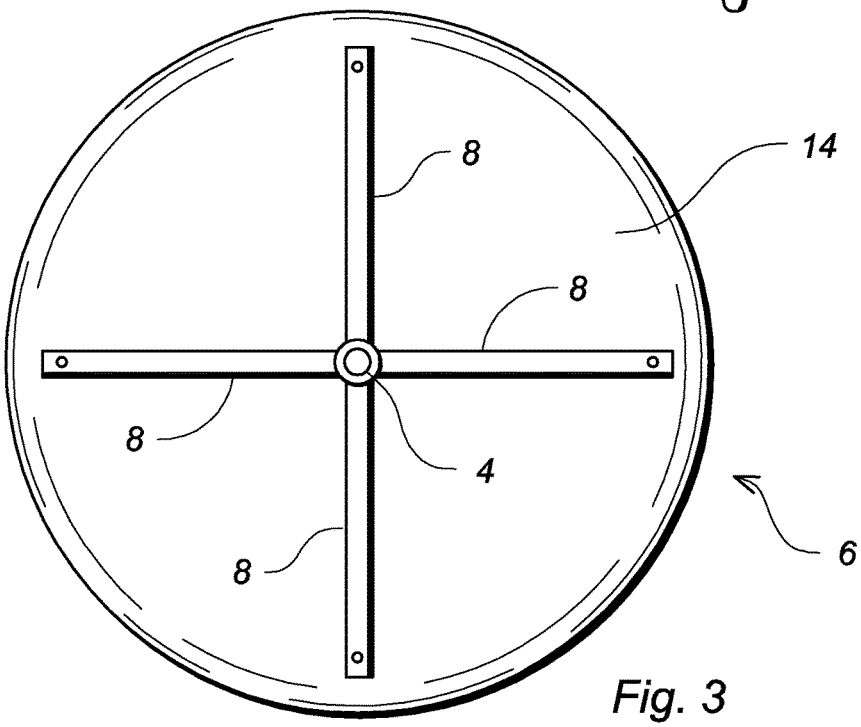
FIG. 3 is a top view of one embodiment of the invention.

In another embodiment as shown in FIG. 3, the support 6 (shown in its expanded position), includes "ribs"—ideally 3 or more—with portions of a thinner material between the ribs. Four ribs 8 are shown in FIG. 3. The ribs 8 are biased, either by virtue of being constructed of an elastomer material or a resilient metal, or with a spring or other biasing components, or other biasing structure well known in the art. When not in contact with a soft material, the ribs 8 and overall support 6 is in the folded position, but when force is exerted on the distal or leading edge of the support 6 and/or the ribs 8, the support 6 expands as shown in FIG. 3. In the folded position, with no force applied to the stick, the biasing of the ribs 8 folds the support 6 to the folded position so that it rests around or close to the stick.

In the embodiment shown in FIG. 3, between the ribs 8 is a flexible, foldable membrane 14, which may be made of the same elastomer material as the ribs 8 or may be a different elastomer or alternatively may be a low elasticity material such as canvas, nylon, or other materials. In the expanded position, as shown in FIG. 3, force has been applied to the stick 4 and the support 6 has opened to present a larger surface area with the membrane 14 stretched between the ribs 8. The configuration shown in FIG. 3 may be a single molded support 6 with pronounced ribs 8 and inner membrane 14 molded in one integrated elastomer support.

Figure 4:
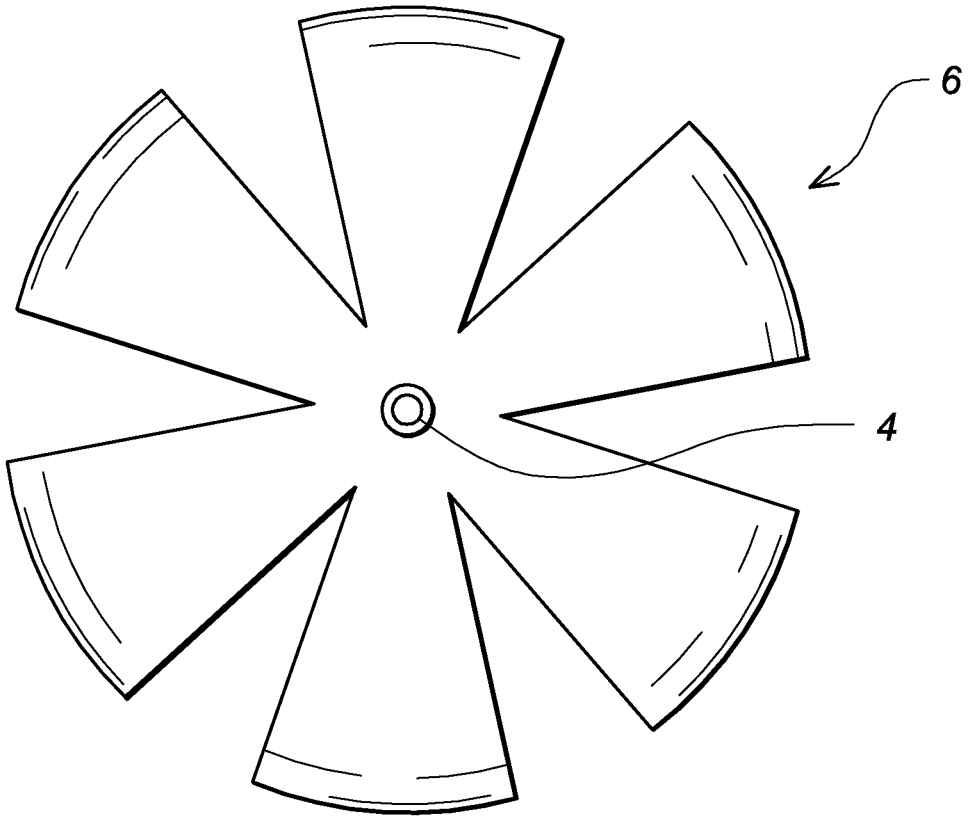
FIG. 4 is a top view of another embodiment of the invention.

In the configuration shown in FIG. 3, the membrane 14 and the ribs 8 create a substantially continuous support surface (with no significant gaps between the ribs and the membrane where mud would pass to the top of the membrane). Similarly in FIGS. 1 and 2 the support 6 extends in a full circle (360 degrees) and has a substantially continuous surface. Alternatively, the support in any of these embodiments may comprise less than a full circle, but ideally would be at least 90 degrees and preferably at least 120 degrees. And the support in either embodiment may have openings or protrusions as shown in FIG. 4. In a support with ribs (similar to that shown in FIG. 3) spanning less than 360 degrees, an additional rib may be provided, without any membrane attached to it but with biasing components as described above for the other ribs. This additional rib is ideally positioned centered in the region without support structure.

The proper support expansion characteristics may optionally be achieved by varying the thickness of the support material (thinner at the leading end and thicker at the proximal end of the stick). The properties of the support material may also be varied so that the support material expands at a different rate based on a given amount of force. Other approaches to designing the support for optimum expansion mechanics are well known to one skilled in the art.

As shown in FIG. 2, it is desirable that the leading or distal edge of the folded support 6 have a curved shape (convex to the point of attachment to the stick) to enhance the expansion of the support 6 as force is applied by mud to that leading edge. In the embodiment shown in FIG. 3, the distal edge of the ribs 8 would ideally have a similar convex shape.

It is also sometimes desirable to cut out portions of the support so that in the expanded position multiple protrusions are defined as shown in FIG. 4 and the footprint of the support reflects those protrusions.

Figure 5:
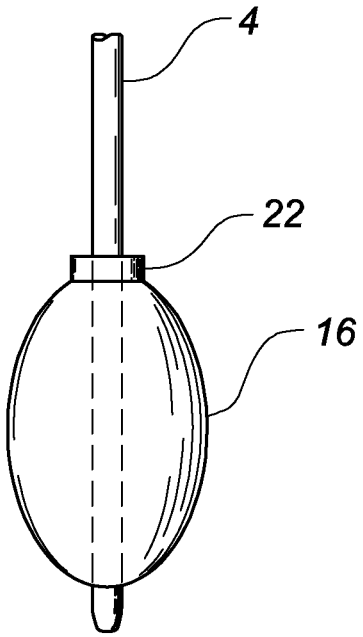
FIG. 5 is a side view of one embodiment of the invention in the closed position.
Figure 6:
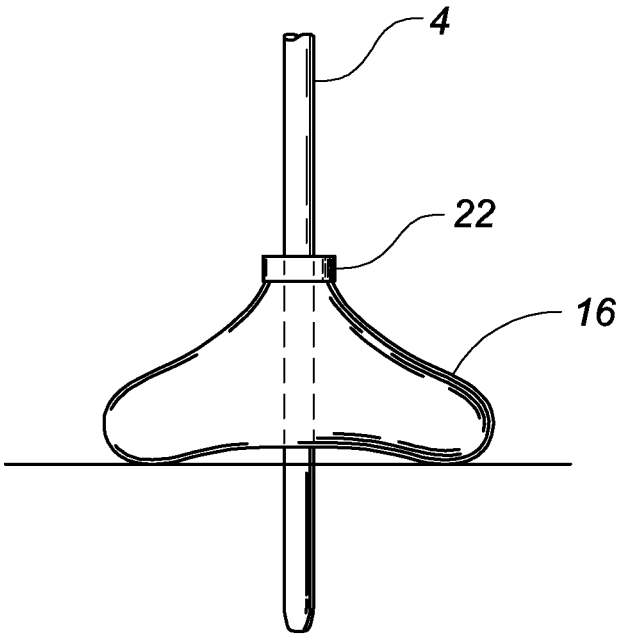
FIG. 6 is a side view of one embodiment of the invention in the expanded position.

In another embodiment shown in FIG. 5 and FIG. 6, the support is a bulb 16 that expands to a greater circumference based on pressure applied to it. The bulb may be made of an elastomer or other suitable flexible material or may have internal flexible ribs to enable suitable expansion and contraction of the bulb. In this configuration, the bulb 16 is attached to the stick 4 at its upper end, such as by bracket 22, and otherwise slides on the stick. Expansion of the bulb 16 occurs as the lower end of the bulb contacts the mud and the base of the bulb moves up the stick as a result of force applied to the stick as shown in FIG. 6. The un-deformed shape of the bulb may be spherical, oval, or other suitable shapes. In a preferred embodiment the bulb 16 is filled with resilient foam to prevent mud or water intrusion into the inside of the bulb.

Figure 7:
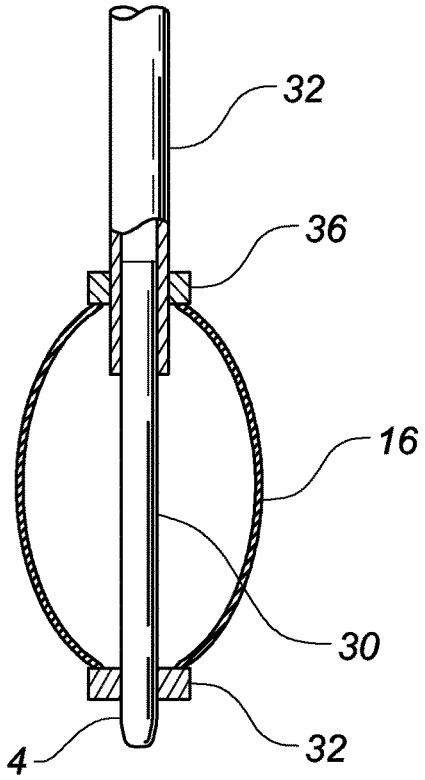
FIG. 7 is a side view of another embodiment of the invention.

FIG. 7 shows the bulb 16 but with a stick having a lower cylindrical inner portion 30 that slides within an upper cylindrical outer portion 32. The lower portion of the bulb 16 is attached to the inner portion 30 at lower attachment ring 32 and the top of the bulb is attached to the outer portion 32 at upper attachment ring 36. Pressing the outer cylindrical portion 32 downward causes expansion of the bulb 16. In any of the embodiments shown in FIG. 5, 6, or 7, the bulb 16 could be comprised of a combination of ribs and membrane and expand in a manner similar to the support shown in FIG. 3.

Figure 8:
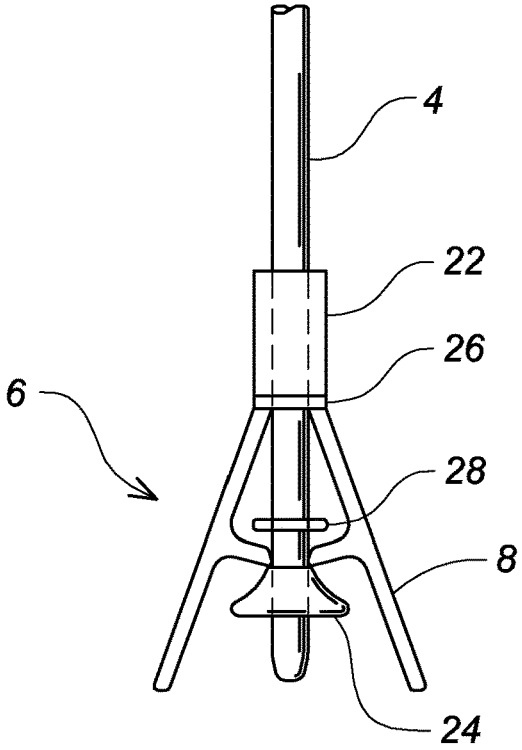
FIG. 8 is a side view of one embodiment of the invention in the closed position.

In yet another embodiment, as shown in FIG. 8, the expansion of the support 6 is enhanced by the application of force to the top of the support 6 (either in lieu of, or in addition to the application of force to the leading edge of the closed support 6 in contact with the mud). The force against the top of the support may also be applied using an actuator as described below. The stick 4 is surrounded by an outer cylindrical portion 22 and the support includes ribs 8 (comparable to those shown in FIG. 3) and a membrane (not shown in FIG. 8 for clarity). The center top of the support 6 includes sliding ring 26 to which the ribs 8 are attached and which slides on the stick 4 (over a limited range of motion) and is contacted by the end of the outer cylindrical portion 22 when a wader presses down on the stick 4. An expansion collar 24 may be affixed to the stick 4 to contact the ribs 8 and push them into an expanded position. The support 6 slides freely on stick 4 within a range defined by the point where the end of the outer cylindrical portion 22 contacts the support 6 at one end of the range and a stop 28 on stick 4 (to prevent the support from dropping too low on the stick) at the other end of the range. The user would grip the outer cylindrical portion 22 and when downward pressure is applied to that outer cylindrical portion 22, downward force is applied to top of the support 6 which is slidably mounted on the inner portion, forcing it downward. As pressure is applied to the stick, force is also exerted on the folded support, either as a result of it being attached to the inner portion of the stick or as a result of the sliding support contacting the lower stop on the inner portion. In addition, some upward force could also be exerted by the mud on the leading edge of the support. All of these scenarios result in smooth expansion of the support. The rib configuration of FIG. 3, as well as the support material and support configuration, may be modified (as well known to one skilled in the art) so that downward pressure on the top center portion of the support facilitates expansion of the support. In an enhanced embodiment, biasing components well known in the art could be provided to allow the user to adjust the displacement of the outer cylindrical portion (and hence the deflection of the support) for a given force applied.

Figure 9:
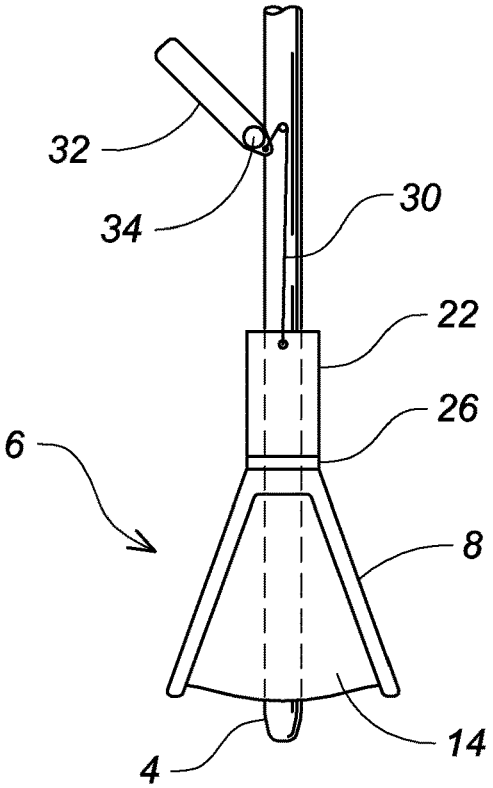
FIG. 9 is a side view of one embodiment of the invention in the closed position with an actuator.

As shown in FIG. 9, in another desirable embodiment, expansion of the support is aided by an actuator which may be controlled by the wader and begins opening (or fully opens) the support to its expanded position. The actuator shown in FIG. 9, which is one of many possible implementations of an actuator known to one skilled in the art, includes a handle 32 near the top of the stick 4 that pivots on hinge 34 and with mechanical linkages 30 so that depressing the handle 32 expands the support 6. Suitable mechanical linkages would be well known to one skilled in the art. Although FIG. 8 and FIG. 9 show a support with ribs and a membrane, these configurations could also utilize a single molded elastomer support. A similar actuator configuration known to one skilled in the art could be utilized to expand the bulb configuration shown in FIG. 5, FIG. 6 and FIG. 7.

In all of the embodiments described, a key feature of this invention is that the expansion of the support is regulated by the force applied (and the resistance of the mud). The contraction of the support as the stick is lifted out of the mud (as described for each of the embodiments) serves to remove mud attached to the stick and well as return the stick to a less bulky configuration that is suitable for use on a firmer surface without need for the expanding support. In the folded position the circumference around the folded support is ideally less than 50% of the circumference around the expanded support. The stick 4 would typically have a diameter of between ½ inch and 2 inches and may have a grip handle at the upper end. The diameter of the expanded support 6 should be at least 2 inches, and preferably at least 4 inches.

The surface(s) of the support that come in contact with the mud would preferably be a non-smooth surface to reduce mud adhesion to the support. The non-smooth surface would ideally be a surface with a plurality of circular, convex bumps extending above the surface having a height of between 1 and 4 mm and a diameter between 2 and 10 mm. There should be at least 10 such bumps per square inch and preferably at least 20 bumps per square inch. Alternatively, the surface of the support could have a series of concave indentations in the same size range, or a combination of such convex bumps and concave indentations again with at least 10, and preferably at least 20, bumps and/or indentations per square inch. In one preferred embodiment the convex bumps have an oblong shape, and in one embodiment those oblong shapes are angled toward the outer edge of the support, so that as the expanded support is extracted from the mud, the mud would slide off the support in the direction the bumps are angled. The non-smooth surface could be the bottom of the support, the entire surface of the support, or other selected portions where mud contact with the support is expected.

In another desirable embodiment, instead of or in addition to the non-smooth surface described above, the support surfaces are treated with a coating that reduces adhesion of mud to the support. Suitable "super hydrophobic" nanocoatings are known, although none have been applied to a structure like that of the present invention. A suitable nanocoating, such as a silica-based nonflourinated coating for rubber, would ideally provide a water contact angle of more than 150 degrees and a sliding angle of less than 10 degrees and ideally less than 8 degrees. Such super hydrophobic properties have been observed in nature on biological surfaces such as the lotus leaf. Super hydrophobic coatings may be comprised of hydrophobic nanoparticles (such as those based on silica, alumina, and other materials known in the art) in a suitable polymer binder or applied as an aerogel with those processes known in the coatings art. In the present invention such a super hydrophobic coating is applied to the upper or lower surface of the support, or ideally both the upper and lower surfaces of the support (with the lower surface being the surface of the support primarily in contact with the mud). This configuration and surface treatment is especially effective when the stick is used while wading because of the significant amount of water contact with the support surfaces between the wader's steps.

I claim:

1. A wading stick comprising (i) a stick having a top and a bottom and (ii) an expanding support having a plurality of separate protrusions that discontinue a round perimeter of said support, said expanding support having a proximal end attached to the stick and a distal end having a circumference, with the circumference of said distal end expanding outward away from the stick and the circumference of said distal end increasing as it expands outwardly in response to contact with a surface and said expanding support having at least two ribs and a flexible membrane between said ribs.

2. The wading stick of claim 1, wherein said expanding support is made of an elastomer.

3. The wading stick of claim 1 with said expanding support biased to return to a closed position when not in contact with a surface.

4. The wading stick in claim 1 with said expanding support having a substantially continuous surface.

5. The wading stick of claim 1 with said expanding support having a super hydrophobic surface.

6. The wading stick of claim 5 with said expanding support having at least one said super hydrophobic surface coated with nanoparticles.

7. The wading stick of claim 1 with the bottom of said stick extending below the distal end of said expanding support when said expanding support is in a closed position.

8. The wading stick of claim 1 wherein said spaced protrusions are equally spaced around the perimeter of said support.

* * * * *